United States Patent [19]

Ohata

[11] Patent Number: 4,903,668

[45] Date of Patent: Feb. 27, 1990

[54] FUEL INJECTION SYSTEM OF AN INTERNAL COMBUSTION ENGINE

[75] Inventor: Akira Ohata, Mishima, Japan

[73] Assignee: Toyota Jidosha Kabushiki Kaisha, Aichi, Japan

[21] Appl. No.: 221,227

[22] Filed: Jul. 19, 1988

[30] Foreign Application Priority Data

Jul. 29, 1987 [JP] Japan ..... 62-189889
Jul. 29, 1987 [JP] Japan ..... 62-189891

[51] Int. Cl.[4] ..... F02D 41/04; F02D 41/34

[52] U.S. Cl. ..... 123/478; 123/480; 364/431.05

[58] Field of Search ..... 123/478, 480, 492, 493; 364/431.05, 431.07

[56] References Cited

U.S. PATENT DOCUMENTS 4,357,923 11/1982 Hideg ..... 123/492
4,388,906 6/1983 Sugiyama et al. ..... 123/492
4,454,847 6/1984 Isomura et al. ..... 123/493 X
4,792,905 12/1988 Sekozawa et al. ..... 123/478 X

FOREIGN PATENT DOCUMENTS 0152019 8/1985 European Pat. Off. .
0184626 6/1986 European Pat. Off. .
0185552 6/1986 European Pat. Off. .
0301548 2/1989 European Pat. Off. .

OTHER PUBLICATIONS

David G. Luenberger: "Introduction to Dynamic Systems": Theory, Models, and Applications, 1979, pp. 300–309, Chapter 8.10, J. Wiley & Sons, Inc., New York, US.

Patent Abstracts of Japan, vol. 10, No. 51 (M-457) [2108], 28th Feb. 1986; & JP-A-60 201 042 (Aisan Kogyo K.K.) 11-10-1985.

*Primary Examiner*—Tony M. Argenbright
*Attorney, Agent, or Firm*—Oliff & Berridge

[57] ABSTRACT

A fuel injecting amount of an internal combustion engine is calculated utilizing equations determined from a physical model describing a behavior of fuel in the engine. The fuel injection system includes estimation means in which estimation values $\hat{f}w$ and $\hat{f}v$ of the adhering fuel amount and the vapor fuel amount respectively are calculated based on: a product $\lambda r \cdot m$ of the detected fuel/air ratio and the detected air amount; a division $Vf/\omega$ of fuel evaporating amount by the engine speed; and a fuel injecting amount q. The fuel injecting amount is calculated in the system based on the division $Vf/\omega$, the estimated values $\hat{f}w$ and $\hat{f}v$, the product $\lambda r \cdot m$, and a summed up deviation from a target ratio. The coefficients of respective terms are determined by analyzing the physical model by modern control theory. A variation of the invention does not use an air/fuel ratio sensor.

9 Claims, 9 Drawing Sheets

FUEL INJECTION SYSTEM OF AN INTERNAL COMBUSTION ENGINE

BACKGROUND OF THE INVENTION

The present invention relates to a fuel injection system of an internal combustion engine, in which the amount of fuel injected by a fuel injection valve, hereforth referred to as the fuel injecting amount, is determined based on a physical model describing a behavior of fuel coming into a cylinder of the engine.

A fuel injection system is disclosed, which determines a fuel injecting amount of a fuel injection valve so that an air/fuel ratio of an air/fuel mixture supplied to an engine is adjusted to coincide with a target ratio, for example, in Published Unexamined Japanese Patent Application No. 59-196930. The system uses identification that the linear approximation holds between a control input and a control output. The control input is regarded as a compensation value for compensating a basic fuel injecting amount obtained from the rotating speed of an engine and the amount of intake air. The control output is regarded as an actual measurement of the air/fuel ratio detected by an air/fuel ratio sensor. Using such identification provides a physical model for describing dynamic behavior of the engine, based on which a control law is designed. The system of this known type, based on the linear control theory, is thus constructed to determine the fuel injecting amount, utilizing the control law.

Actually, however, the linear relationship does not hold between the control input and the control output. The physical model obtained from a simple linear approximation, thus, is allowed to describe the dynamic behavior of the engine accurately only in a very limited operating condition. For this reason, the conventional systems suppose several physical models in several regions of the engine operation in each of which the linear approximation can almost hold. Accordingly several control laws corresponding to the physical models must be designed in respective regions. In the aforementioned system, control laws have to be switched depending on the physical model in the respective region of the engine operation, resulting in cumbersome control. Switching the control law might cause the control at the boundary between the regions to be unstable.

A system of this type uses an approximation by lower order physical model for improving responsiveness of the control by reducing calculating time. In this method, an approximation error or an error due to the difference among individual engines is absorbed by an integral operation. However, in the conventional method, the physical model is provided based on physically meaningless state variables on the assumption that the linear approximation can hold between the control output and control input. Hence approximating the physical model by lower order will deteriorate the control accuracy because of the increase in the amount of the integral term.

Further, since the above system determines the fuel injecting amount in accordance with an actual measurement of an air/fuel ratio detected by an air/fuel ratio sensor as the control output, the control cannot be applied to an engine with no such sensor.

SUMMARY OF THE INVENTION

It is an object of the present invention to provide a fuel injection system of an internal combustion engine, which determines the fuel injecting amount with great accuracy without switching control laws.

It is another object of the invention to provide a fuel injection system of an internal combustion engine, which adjusts an air/fuel ratio to a target ratio without using a sensor for detecting the air/fuel ratio.

One feature of the present invention is, as shown in FIG. 1A, a fuel injection system of an internal combustion engine M2 for determining a fuel injecting amount q of a fuel injection valve M4 based on a physical model describing a behavior of fuel coming into a cylinder M3 of the engine M2. The system utilizes an amount fw of fuel adhering to an inner wall of an intake pipe M1 and an amount fv of vapor fuel in the intake pipe M1 as state variables. The system comprises:

an operating state detection means M5 for detecting the rotating speed $\omega$ of the engine M2, an evaporating amount Vf of the fuel adhering to the inner wall of the intake pipe M1, fuel/air ratio $\lambda$ of a mixture coming into the cylinder M3, and an amount m of air coming into the cylinder M3;

a dividing means M6 for dividing the evaporating amount Vf by the engine speed $\omega$;

an estimation means M7 for estimating the adhering fuel amount fw and the vapor fuel amount fv, based on a product $\lambda \cdot m$ of the detected fuel/air ratio $\lambda$ and the detected air amount m, the division $Vf/\omega$ at the dividing means M6 and the injecting amount q, utilizing a first equation determined from the physical model;

a summing means M8 for summing up a difference $m \cdot (\lambda - \lambda r)$ between the product $\lambda \cdot m$ and a product $\lambda r \cdot m$ of a preset target fuel/air ratio $\lambda r$ and the air amount m; and a fuel injecting amount calculation means M9 for calculating the fuel injecting amount q, based on the division $Vf/\omega$, the estimated adhering fuel amount $\hat{f}w$, the estimated vapor fuel amount $\hat{f}v$, the product $\lambda r \cdot m$ of the target fuel/air ratio $\lambda r$ and the air amount m and the difference summed at the summing means M8, utilizing a second equation determined from the physical model.

The operating state detection means M5 detects: the rotating speed $\omega$ of the engine M2, i.e., an engine speed; an evaporating amount Vf of the fuel adhering to the inner wall of the intake pipe M1; fuel/air ratio $\lambda$ of a mixture coming into the cylinder M3; and an amount m of air coming into the cylinder M3.

A known engine speed sensor can be used for detecting the engine speed $\omega$. A known air/fuel ratio sensor equipped to an exhaust system of an engine which outputs detection signals in accordance with the concentration of oxygen in the exhaust gas can be used in the operating state detection means M5.

The evaporating amount Vf can be derived from a known function between a saturated vapor pressure Ps of the fuel in the intake pipe M1 and a pressure P in the intake pipe M1 (intake pipe pressure). The saturated vapor pressure Ps is hardly obtained by a sensor. So the following equation (1) is utilized for providing it. The pressure Ps is a function of a temperature T of the fuel. The temperature T can be represented by either the water temperature of a water jacket of the engine M2, or the temperature of a cylinder head adjacent to the intake port. Thus the temperature T (°K), either in the water jacket or in the cylinder head detected by a temperature sensor is used as the parameter in the equation (1):

$$Ps=\beta 1\cdot T^2-\beta 2\cdot T+\beta 3 \quad (1)$$

where $\beta 1$, $\beta 2$, $\beta 3$ are proper constants.

First, the saturated vapor pressure Ps is obtained based on temperature signals from the sensor at the water jacket or at the cylinder head. Then a pressure P in the intake pipe is sensed by a known pressure sensor. The fuel evaporating amount Vf is detected by utilizing a predetermined data map or a predetermined equation based on the saturated vapor pressure Ps and the intake pipe pressure P. Alternatively, since the fuel evaporating amount Vf greatly changes dependent on the pressure Ps, it may be obtained with approximation from the following equation (1)' using only Ps as the parameter:

$$Vf=\beta 4\cdot Ps \quad (1)'$$

where $\beta 4$ is a constant.

The air amount m coming into the cylinder M3 can be easily obtained, for example, from the following equation (2). When the engine speed $\omega$ is constant, the air amount m is approximated by a linear function of the pressure P, such as:

$$m=\{\beta\times(\omega)\cdot P-\beta y(\omega)\}/Ti, \quad (2)$$

where $\beta\times(\omega)$ and $\beta y(\omega)$ are coefficients depending on the engine speed $\omega$. Accordingly the air amount m is detected based on the pressure P and the temperature Ti detected by the respective known sensors, and the engine speed $\omega$ detected by the aforementioned sensor, utilizing the above equation (2). Also, the air amount m may be detected by compensating a basic air amount m by the temperature Ti. The basic air amount m is obtained from a predetermined map using the pressure P and the engine speed $\omega$ as parameters. The air amount m coming into the cylinder M3 at intake stroke still can be estimated based on the amount of the air coming into the intake pipe M1 detected by a known air flow meter attached upstream of a throttle valve.

An example of the physical model as the basis of the above inventive construction will be described.

A fuel amount fc coming into the cylinder M3 of the engine M2 is given by the following equation (3), using the fuel injecting amount q of the fuel injection valve M4, the adhering fuel amount fw and the vapor fuel amount fv.

$$fc=\alpha 1\cdot q+\alpha 2\cdot fw+\alpha 3\cdot fv \quad (3)$$

The above equation is given because the fuel amount fc is considered as the sum of a direct influx $\alpha 1\cdot q$ by the fuel injected from the fuel injection valve M4, an indirect influx $\alpha 2\cdot fw$ spilling from the intake pipe M1 to which the injected fuel adheres, and a vapor fuel influx $\alpha 3\cdot fv$ remaining in the intake pipe M1 due to evaporation of either the injected fuel or the fuel adhering to the inner wall.

Since the fuel injecting amount q is determined by the control parameter of the fuel injection valve M4 (e.g., injection valve opening time), which is a known variable, the fuel amount fc can be estimated if the adhering fuel amount fw and the vapor fuel amount fv are obtained as hereforth explained.

The adhering fuel amount fw decreases by $\alpha 2$ at every intake cycle caused by the flow into the cylinder M3 at the intake stroke as well as by evaporation in the intake pipe M1. Conversely it increases by $\alpha 4$ which is a part of the fuel injecting amount q injected from the fuel injection valve M4 synchronously with the intake cycle. The amount of the fuel evaporating at every intake stroke can be represented as $\alpha 5\cdot Vf/\omega$. Thus the adhering fuel amount fw is given by the following equation (4):

$$fw(k+1)=(1-\alpha 2)\cdot fw(k)+\alpha 4\cdot q(k)-\alpha 5\cdot Vf(k)/\omega(k) \quad (4)$$

where k is a number of the intake cycle time.

The vapor fuel amount fv decreases by $\alpha 3$ at every intake cycle caused by the flow into the cylinder M3 at the intake stroke. It increases by $\alpha 6$ due to the evaporation of a part of the fuel injecting amount q. It further increases by the evaporation of the adhering fuel. The vapor fuel amount fv is given by the following equation (5).

$$fv(k+1)=(1-\alpha 3)\cdot fv(k)+\alpha 6\cdot q(k)+\alpha 5\cdot Vf(k)/\omega(k) \quad (5)$$

A fuel amount fc(k) admitted into the cylinder M3 of the engine M2 is represented by the following equation (6) using a fuel/air ratio $\lambda(k)$ which can be detected from the concentration of the oxygen in the exhaust gas, and the air amount m(k) coming into the cylinder M3.

$$fc(k)=\lambda(k)\cdot m(k) \quad (6)$$

When the coefficients $\alpha 1$ through $\alpha 6$ of the respective equations are determined by the known method of system identification, a state equation (7) and an output equation (8) are obtained as shown below. Both equations use the adhering fuel amount and the vapor fuel amount as state variables, and are described in a discrete system taking the intake cycle of the engine as a sampling cycle. Those equations determine a physical model for describing behavior of fuel in the engine.

$$\begin{bmatrix} fw(k+1) \\ fv(k+1) \end{bmatrix}=\begin{bmatrix} 1-\alpha 2 & 0 \\ 0 & 1-\alpha 3 \end{bmatrix}\cdot\begin{bmatrix} fw(k) \\ fv(k) \end{bmatrix}+\begin{bmatrix} \alpha 4 \\ \alpha 6 \end{bmatrix}\cdot q(k)+\begin{bmatrix} -\alpha 5 \\ +\alpha 5 \end{bmatrix}\cdot Vf(k)/\omega(k) \quad (7)$$

$$\lambda(k)\cdot m(k)=[\alpha 2\ \alpha 3]\cdot\begin{bmatrix} fw(k) \\ fv(k) \end{bmatrix}+(1-\alpha 4-\alpha 6)\cdot q(k) \quad (8)$$

The estimation means M7 obtains estimations $\hat{f}w$ and $\hat{f}v$ of the state variables fw and fv, based on: a product $\lambda\cdot m$ (which represents fuel amount coming into the cylinder) of the fuel/air ratio $\lambda$ and the air amount m both of which are detected by the operating state detection means M5, the division $Vf/\omega$; from the dividing means M6, and the fuel injecting amount q of the fuel injection valve M4. Here the calculation utilizes the first equation set in accordance with the aforementioned physical model. Since the adhering fuel amount fw and the vapor fuel amount fv cannot be detected directly by a sensor like the engine speed $\omega$ or the fuel/air ratio $\lambda$, nor detected even indirectly by calculations from detected results of sensors like the fuel evaporating amount Vf or the air amount m, they are estimated by the estimation means M7.

The estimation means M7 may have a construction of known observers like minimal order observer, identity observer, dead beat observer, linear function observer, or adaptive observer. The design methods of the observers are explained in detail in "Introduction to Dynamic System—Theory, Models and Applications" by David G. Luenberger, John Wiley & Sons Inc., N.Y. (1979).

The fuel injecting amount calculation means M9 calculates the fuel injecting amount q of the fuel injection valve M4 based on the division $Vf/\omega$ from the dividing means M6, the estimations $\hat{f}w$ and $\hat{f}v$ from the estimation means M7, the product $\lambda r \cdot m$ of the target fuel/air ratio $\lambda r$ and the air amount m, i.e., target fuel amount coming into the cylinder M3, and the sum calculated by the summing means M8, utilizing the second equation determined from the physical model.

The fuel injecting amount calculation means M9 is so constructed to calculate the control variable of the servo system compensated for the non-linearity. The control variable is a sum of the products as follows: the products of the state variables $\hat{f}w$ and $\hat{f}v$ estimated by the estimation means M7 and coefficients predetermined by the physical model; the product of sum of differences added by the difference between the target fuel amount $\lambda rm$ and the measured fuel amount $\lambda m$ and coefficients predetermined by the physical model so as to approach the fuel amount $\lambda m$ to the target amount $\lambda rm$ under the existence of disturbance; and the product of the division $Vf/\omega(k)$ calculated by the dividing means M6 and coefficients predetermined by the physical model.

In the above constructed fuel injection system of the invention, the estimation means M7 estimates the state variables $\hat{f}w$ and $\hat{f}v$ based on the product $\lambda \cdot m$ of the fuel/air ratio $\lambda$ and the air amount m detected by the operating state detection means M5, the division $Vf/\omega$ calculated by the dividing means M6, and the fuel injecting amount q of the fuel injection valve M4, utilizing the first equation determined from the physical model. The fuel injecting amount calculation means M9 calculates the fuel injecting amount q of the fuel injection valve M4 based on the division $Vf/\omega$ from the dividing means M6, the estimations $\hat{f}w$ and $\hat{f}v$ from the estimation means M7, the product $\lambda r \cdot m$ of the target fuel/air ratio $\lambda r$ and the air amount m detected by the operating state detection means M5, and the sum calculated by the summing means M8, utilizing the second equation determined from the physical model.

The fuel injection system of the present invention calculates the fuel injecting amount in accordance with the control law determined from the physical model which describes the fuel behavior in the engine as shown by the equations (7) and (8), utilizing the adhering fuel amount and the vapor fuel amount as state variables. The fuel injecting amount of the engine, thus, is subjected to a feedback control.

The fuel injection system of an internal combustion engine of this invention sets a control law in accordance with a physical model describing the fuel behavior in the engine, and is compensated for the non linearity in accordance with the division calculated by the dividing means M6. Therefore the system allows a single control law to cover the control of the fuel injecting amount with great accuracy under wide-ranging operating conditions of the engine. Accordingly its construction is further simplified and can be expressed in lower order, thereby improving responsiveness of the control.

Another feature of the present invention is, as shown in FIG. 1B, a fuel injection system of an internal combustion engine M2 for determining an injecting amount q of a fuel injection valve M4 based on a physical model describing a behavior of fuel coming into a cylinder M3 of the engine M2 utilizing an amount fw of fuel adhering to an inner wall of an intake pipe M1 and an amount fv of vapor fuel in the intake pipe M1 as state variables. The system comprises:

an operating state detection means M15 for detecting a rotating speed $\omega$ of the engine M2, an evaporating amount Vf of the fuel adhering to the inner wall of the intake pipe M1 and an amount m of air coming into the cylinder M3;

a dividing means M16 for dividing the evaporating amount Vf by the engine speed $\omega$;

an estimation means M17 for calculating estimation values $\hat{f}w$ and $\hat{f}v$ of the adhering fuel amount fw and the vapor fuel amount fv, based on the division $Vf/\omega$ at the dividing means M16 and the injecting amount q, utilizing a first equation determined from the physical model; and a fuel injecting amount calculation means M19 for calculating the fuel injecting amount q, based on the division $Vf/\omega$, the estimation values $\hat{f}w$ and $\hat{f}v$, and a product $\lambda r \cdot m$ of the detected air amount m and a target fuel/air ratio $\lambda r$, utilizing a second equation determined from the physical model.

This feature is characterized in that the operating state detection means M15 does not detect the fuel/air ratio of the mixture. The estimation means M17 estimates fw and fv without utilizing $\lambda \cdot m$ and the fuel injecting amount calculation means M19 calculates the injecting amount q without the summed up difference. This system is enabled to adjust the air/fuel ratio to the target air/fuel ratio without the sensor for detecting the air/fuel ratio, thereby simplifying the construction of the system.

DETAILED DESCRIPTION OF THE PREFERRED EMBODIMENTS

A first embodiment of the present invention will be described with reference to the drawings.

Figure 2:
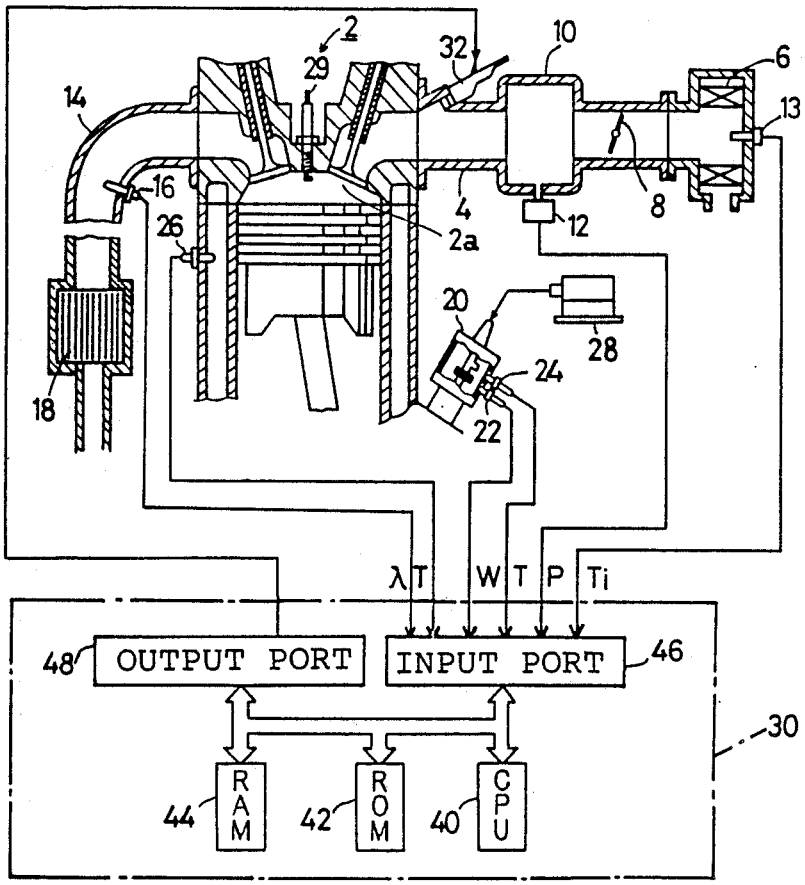
FIG. 2 is a schematic diagram illustrating an internal combustion engine and its peripheral equipment according to a first embodiment of the present invention.

Shown in FIG. 2, an intake pipe 4 admits air through an air cleaner 6. The intake pipe 4 is provided with a throttle valve 8 for controlling the flow of the admitted air, a surge tank 10 for suppressing pulsation of the admitted air, a sensor 12 for detecting a pressure P in the intake pipe 4 (intake pipe pressure), and a sensor 13 for detecting an intake air temperature Ti.

An exhaust pipe 14 is provided with an oxygen sensor 16 for detecting a fuel/air ratio of an air/fuel mixture coming into a cylinder 2a of an internal combustion engine 2 in accordance with the concentration of oxygen in the exhaust gas, and a three way catalytic converter 18 for treating the exhaust gas. Residual HC of the fuel and the combustion residues such as CO and NOx in the exhaust gas are converted into harmless gases in the three way catalytic converter 18.

The engine 2 is provided with sensors for detecting operating states thereof such as an engine speed sensor 22 for detecting the engine speed $\omega$ in accordance with the rotation of a distributor 20, a crank angle sensor 24 for detecting a fuel injecting timing t to the engine 2 in accordance with the rotation of the distributor 20, a water temperature sensor 26 installed on a water jacket of the engine 2 for detecting a cooling water temperature T, and the aforementioned sensors 12, 13, and 16. The distributor 20 is so constructed to apply high voltage from an igniter 28 to spark plugs 29 at a predetermined ignition timing.

Signals detected by the respective sensors are fed to an electronic control circuit 30 constructed as an arithmetic logic circuit including a microcomputer to be used for driving a fuel injection valve 32 to control the amount of the fuel injected therefrom.

The electronic control circuit 30 comprises a CPU 40, a ROM 42, a RAM 44, an input port 46, and an output port 48. The CPU 40 performs arithmetic operations for the fuel injection control in accordance with a predetermined control program. The control program and initial data used for the operation by the CPU 40 are stored in the ROM 42. The data used for the operation are temporarily stored in the RAM 44. The detected signals from the respective sensors are received through the input port 46. A driving signal to the fuel injection valve 32 responding to the result operated by the CPU 40 is supplied through the output port 48. The electronic control circuit 30 is constructed to perform feedback control of a fuel injecting amount q of the fuel injection valve 32 so that the fuel/air ratio $\lambda$ of the mixture coming into the cylinder 2a of the engine 2 is adjusted to the target fuel/air ratio $\lambda r$ set in accordance with the respective operating state of the engine 2.

A control system used for the feedback control will be described with reference to a block diagram of FIG. 3, which does not show any hardware structure. Actually it is realized as a discrete system by executing a series of programs shown in the flowchart of FIG. 4. The control system of this embodiment is designed based on a physical model represented by the equations (7) and (8).

Figure 3:
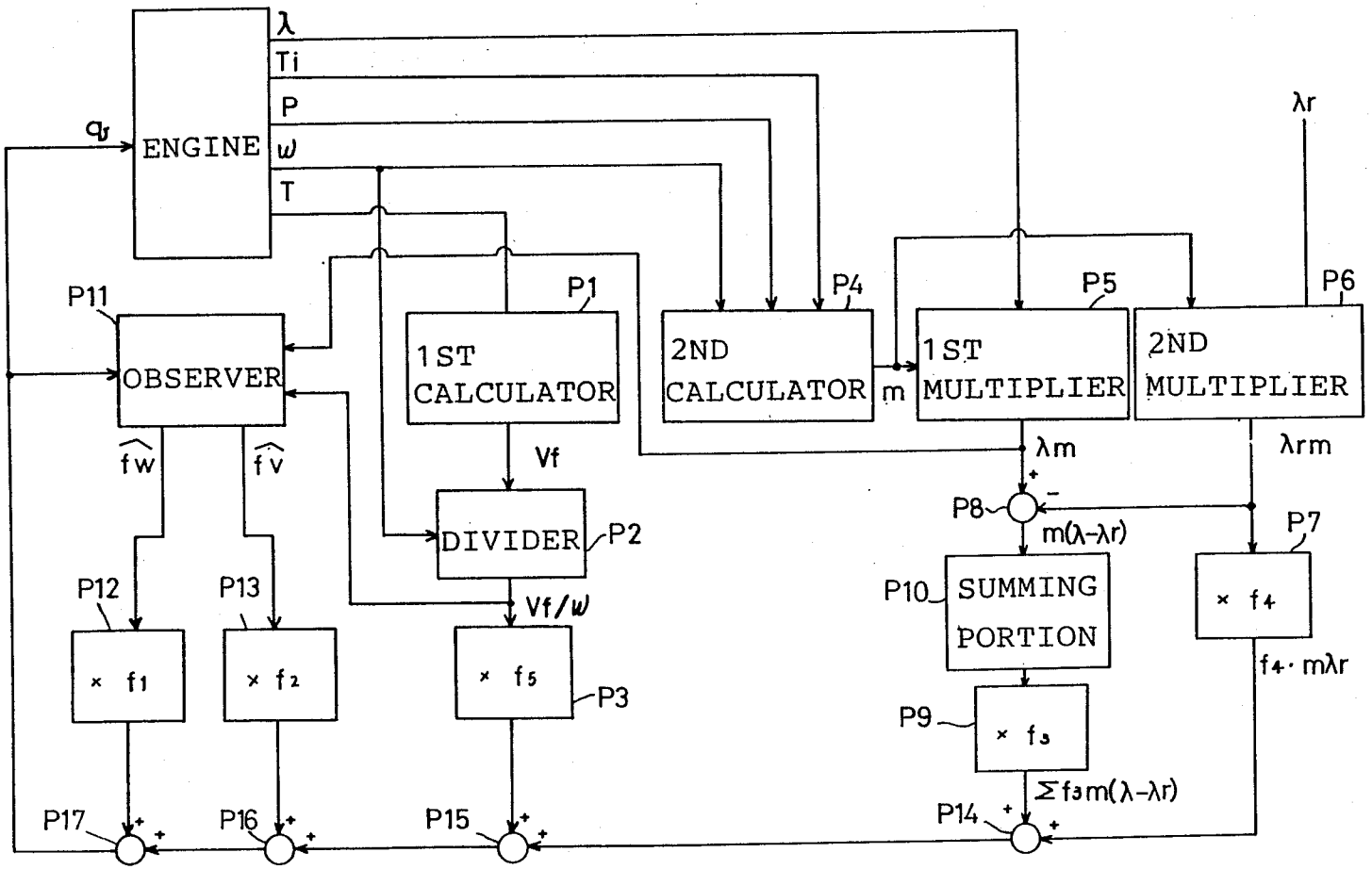
FIG. 3 is a block diagram representing a control system of the present invention.

Referring to FIG. 3, in the control system of this embodiment, the temperature T detected by the sensor 26 is input to a first calculator P1. Then a saturated vapor pressure Ps is calculated based on the input temperature T, utilizing the equation (1). Further a fuel evaporating amount Vf is calculated based on the pressure Ps, utilizing the equation (1)'. The fuel evaporating amount Vf is input to a divider P2 to be divided by the engine speed $\omega$ detected by the sensor 22. The division $Vf/\omega$ is input to a multiplier P3 to be multiplied by a predetermined coefficient f5.

The engine speed $\omega$ detected by the sensor 22 is input to a second calculator P4 along with the pressure P detected by the sensor 12, and the temperature Ti detected by the sensor 13. The second calculator P4 calculates an air amount m coming into the cylinder 2a based on the engine speed $\omega$, the pressure P, and the temperature Ti, utilizing equation (2). The calculated result is output to both a first multiplier P5 and a second multiplier P6. At the first multiplier P5, a fuel/air ratio $\lambda$ of the mixture coming into the cylinder 2a detected by the oxygen sensor 16 is multiplied by the air amount m calculated by the second calculator P4, resulting in the actual fuel amount $\lambda \cdot m$ coming into the cylinder 2a.

At the second multiplier P6, a target fuel/air ratio $\lambda r$ determined in accordance with the load imposed on the engine 2 is multiplied by the air amount m calculated by the second calculator P4, resulting in a calculated required fuel amount $\lambda r \cdot m$ (target fuel amount) to come into the cylinder 2a. The target fuel amount $\lambda r \cdot m$ calculated by the multiplier P6 is input to a multiplier P7 to be multiplied by a predetermined coefficient f4.

The products of the first and the second multipliers P5 and P6 are input to a difference operating portion P8 where the difference of the products $m \cdot (\lambda - \lambda r)$ is calculated. The difference is summed up at a summing portion P10, which is further multiplied by a predetermined coefficient f3 at a multiplier P9.

The actual fuel amount $\lambda \cdot m$ calculated by the first multiplier P5 and the division $Vf/\omega$ calculated by the divider P2 are output to an observer P11. The observer P11 is so constructed to estimate the adhering fuel amount $\hat{f}w$ and the vapor fuel amount $\hat{f}v$ based on the actual fuel amount $\lambda \cdot m$, division $Vf/\omega$ from the divider P2, the fuel injecting amount q of the fuel injection valve 32, and the adhering fuel amount fw and the vapor fuel amount $\hat{f}v$ which are estimated in the previous execution of the same routine, utilizing a predetermined equation. The obtained estimations $\hat{f}w$ and $\hat{f}v$ are multiplied by coefficients f1 and f2 at multipliers P12 and P13, respectively.

The products obtained from the multipliers P12 and P13, along with the products from other multipliers P4, P7 and P10, are added by adders P14 through P17. Accordingly the fuel injecting amount q of the fuel injection valve 32 is determined.

A design method for the aforementioned control system in FIG. 3 will be explained. A design method for the control system of this type is described in detail, as for example, in the above-cited reference. Therefore the method is described only briefly herein. This embodiment uses the Smith-Davison design method.

The control system of this embodiment is designed based on the aforementioned physical model represented by the equations (7) and (8). This physical model with non-linearity is linearly approximated.

If the following equations are provided:

$$y(k) = \lambda(k) \cdot m(k) - (1 - \alpha 4 - \alpha 6) \cdot q(k) \tag{9}$$

$$x(k) = [fw(k)\ fv(k)]^T \tag{10}$$

$$\Phi = \begin{bmatrix} 1 - \alpha 2 & 0 \\ 0 & 1 - \alpha 3 \end{bmatrix} \tag{11}$$

$$\Gamma = \begin{bmatrix} \alpha 4 \\ \alpha 6 \end{bmatrix} \tag{12}$$

$$\pi = \begin{bmatrix} -\alpha 5 \\ +\alpha 5 \end{bmatrix} \tag{13}$$

-continued $$\theta = [\alpha 2\ \alpha 3] \tag{14}$$

the equations (7) and (8) are represented by the following equations.

$$x(k+1)=\Phi\cdot x(k)+\Gamma\cdot q(k)+\pi\cdot Vf(k)/\omega(k) \tag{15}$$

$$y(k)=\Phi\cdot x(k) \tag{16}$$

Suppose a disturbance W(k) is added to the right side of the equation (15), the equations (15) and (16) will be as shown by the following equations (15)' and (16)'. Variables at this time are represented by subscript a.

$$xa(k+1)=\Phi\cdot xa(k)+\Gamma\cdot qa(k)+\pi\cdot Vf(k)/\omega(k)+E\cdot W(k) \tag{15'}$$

$$ya(k)=\Phi\cdot xa(k) \tag{16'}$$

Suppose y(k)=yr (target value), the equations (15) and (16) are represented by the following equations (15)" and (16)".

$$xr=\Phi\cdot xr+\Gamma\cdot qr+\pi\cdot Vf(k)/\omega(k) \tag{15''}$$

$$yr=\Phi\cdot xr \tag{16''}$$

From the above equations (15)", (15)" and (16)', (16)", the equations (17) and (18) are obtained.

$$xa(k+1)-xr=\Phi\cdot(xa(k)-xr)+\Gamma\cdot(qa(k)-qr)+E\cdot W(k) \tag{17}$$

$$ya(k)-yr=\Phi\cdot(xa(k)-xr) \tag{18}$$

Suppose $\Delta W(k)=W(k)-W(k-1)=0$, on the assumption that disturbance W changes in a stepwise fashion in the equation (17), the equations (17)' and (18)' are obtained from the equations (17) and (18).

$$\Delta(xa(k+1)-xr)=\Phi\cdot\Delta(xa(k)-xr)+\Gamma\cdot\Delta(qa(k)-qr) \tag{17'}$$

$$\Delta(ya(k)-yr)=\Phi\cdot\Delta(xa(k)-xr) \tag{18'}$$

Therefore, the above equations (17)' and (18)' entail a state equation which is linearly approximated and extended to a servo system as shown by the following equation (19).

$$\begin{bmatrix}\Delta(xa(k+1)-xr)\\ ya(k)-yr\end{bmatrix}=\begin{bmatrix}\Phi & 0\\ \theta & I\end{bmatrix}\cdot\begin{bmatrix}\Delta(xa(k)-xr)\\ ya(k-1)-yr\end{bmatrix}+\begin{bmatrix}\Gamma\\ 0\end{bmatrix}\cdot\Delta(qa(k)-qr) \tag{19}$$

The above equation (19) is rewritten to the following equation (20).

$$\delta X(k+1)=Pa\cdot\delta X(k)+Ga\cdot u(k) \tag{20}$$

A quadratic criterion function in the discrete system can be represented as follows.

$$J=\sum_{k=0}^{\infty}[\delta X^T(k)\cdot Q\cdot\delta X(k)+\delta u^T(k)\cdot R\ \delta u(k)] \tag{21}$$

With weighted parameter matrices Q and R selected, the input δu (k) for minimizing the quadratic criterion function J is obtained from the next equation (22).

$$\delta u(k)=F\cdot\delta X(k) \tag{22}$$

The optimal feedback gain F in the equation (19), thus, is determined by:

$$F=-(R+Ga^T\cdot M\cdot Ga)^{-1}\cdot Ga^T\cdot M\cdot Pa \tag{23}$$

where M is a regular symmetric matrix satisfying a discrete Ricacci equation shown by $$M=Pa^T\cdot M\cdot Pa+Q-(Pa^T\cdot M\cdot Ga)\cdot(R+Ga^T\cdot M\cdot Ga)^{-1}\cdot(Ga^T\cdot M\cdot Pa) \tag{24}$$

Hence Δ(qa(k)−qr) is given by:

$$\Delta(qa(k)-qr)=[F1\ F2]\cdot\begin{bmatrix}\Delta(xa(k)-xr)\\ ya(k-1)-yr\end{bmatrix} \tag{25}$$

where F is [F1 F2].

With the above equation (25) integrated, qa(k)−qr is given by $$qa(k)-qr=F1\cdot(xa(k)-xr)+\sum_{j=0}^{k-1}F2\cdot(ya(j)-yr)-F1\cdot(xa(0)-xr)+(qa(0)-qr) \tag{26}$$

When control is performed according to equation (26) under the condition of equations (15)" and (16)", i.e., y(k)=yr, the following equation (27) is given.

$$qr=F1\cdot xr\cdot F1\cdot xa(0)+ya(0) \tag{27}$$

Then substituting the equation (27) into the equation (15)" provides the following equation.

$$xr-[(\Phi+\Gamma F1]\cdot xr+\Gamma\cdot(-F1\cdot xa(0)+qa(0))+\pi\cdot Vf(k)/\omega(k) \tag{28}$$

Suppose $xa(k+1)=x(k)$ $(k\rightarrow\infty)$, the following equations are obtained.

$$xr(k)=[I-\Phi-\Gamma\cdot F1]^{-1}\cdot\Gamma\cdot(-F1\cdot xa(0)+qa(0))+\Phi\cdot[I-\Phi-\Gamma\cdot F1]^{-1}\cdot\pi Vf(k)/\omega(k) \tag{29}$$

$$Yr(k)=\Phi\cdot[I-\Phi-\Gamma\cdot F1]^{-1}\cdot\Gamma\cdot(-F1\cdot xa(0)+qa(0))+\Phi\cdot[I-\Phi-\Gamma\cdot F1]^{-1}\cdot\Gamma\cdot Vf(k)/\omega(k) \tag{30}$$

Therefore the following equation is provided.

$$-F1\cdot xa(0)+qa(0)=[\theta\cdot[I-\Phi-\Gamma\cdot F1]^{-1}\cdot\Gamma]^{-1}\cdot yr-[\theta\cdot[I-\Phi-\Gamma\cdot F1]^{-1}\cdot\Gamma]^{-1}\cdot\theta\cdot[I-\Phi-\Gamma\cdot F1]^{-1}\cdot\pi\cdot Vf(k)/\omega(k) \tag{31}$$

In the equation (31), substituting the following equations (32) and (33) into the equation (26) provides the equation (34).

$$F3=[\theta\cdot[I-\Phi-\Gamma\cdot F1]^{-1}\cdot\Gamma]^{-1} \tag{32}$$

$$F4=-[\theta\cdot[I-\Phi-\Gamma\cdot F1]^{-1}\cdot\Gamma]^{-1}\cdot\theta\cdot \tag{33}$$

-continued $$[I - \Phi - \Gamma \cdot F1]^{-1}$$

$$qa(k) = F1 \cdot xa(k) + \sum_{j=1}^{k-1} F2 \cdot (ya(j) - yr) + F3 \cdot yr + F4 \cdot Vf(k)/\omega(k) \quad (36)$$

Substituting the equations (9) and (10) into the equation (34) provides $$\begin{aligned} q(k) &= \Big\{ Fa \cdot fw(k) + Fb \cdot fv(k) + \sum_{j=0}^{k-1} Fc \cdot m(j) \cdot (\lambda(j) - \lambda r) + Fd \cdot m(k) \cdot \lambda r + Fe \cdot Vf(k)/\omega(k) \Big\} / \{1 + Fd \cdot (1 - \alpha 4 - \alpha 6)\} \\ &= f1 \cdot fw(k) + f2 \cdot fv(k) + \sum_{j=0}^{k-1} f3 \cdot m(j) \cdot (\lambda(j) - \lambda r) + f4 \cdot m(k) \cdot \lambda r + f5 \cdot Vf(k)/\omega(k) \end{aligned} \quad (36)$$

Accordingly the control system shown in FIG. 3 is designed. The equation (36) corresponds to the second equation for calculating the fuel injecting amount.

The observer P11 is so constructed to estimate the adhering fuel amount fw and the vapor fuel amount fv in the equation (36) since they cannot be directly measured. Gopinath design method or the like is known for the design method of the observer of this type, which is described in detail by the cited "Basic System Theory". Here the minimal order observer is adopted.

If the following equation (37) is provided, the aforementioned equation (15) is rewritten to the equation (38) as below.

$$\Delta u(k) = \Gamma \cdot q(k) + \pi \cdot Vf(k)/\omega(k) = [\Gamma \ \pi] \cdot \begin{bmatrix} q(k) \\ Vf(k)/\omega(k) \end{bmatrix} \quad (37)$$

$$x(k+1) = \Phi \cdot x(k) + \Delta u(k) \quad (38)$$

The generalized system of the observer for the physical model represented by the above equations (38) and (16) is determined as the following equation (39).

$$\hat{x}(k+1) = \hat{A} \cdot x(k) + \hat{B} \cdot y(k) + \hat{J} \cdot u(k) \quad (39)$$

Therefore the observer P11 of this first embodiment can be designed as the following equation (40), by which the adhering fuel amount fw and the vapor fuel amount fv are estimated.

$$\begin{bmatrix} \hat{fw}(k+1) \\ \hat{fv}(k+1) \end{bmatrix} = \hat{A} \cdot \begin{bmatrix} \hat{fw}(k) \\ \hat{fv}(k) \end{bmatrix} + \hat{B} \cdot \lambda m(k) + \hat{J} \cdot \begin{bmatrix} q(k) \\ Vf(k)/\omega(k) \end{bmatrix} \quad (40)$$

Figure 4:
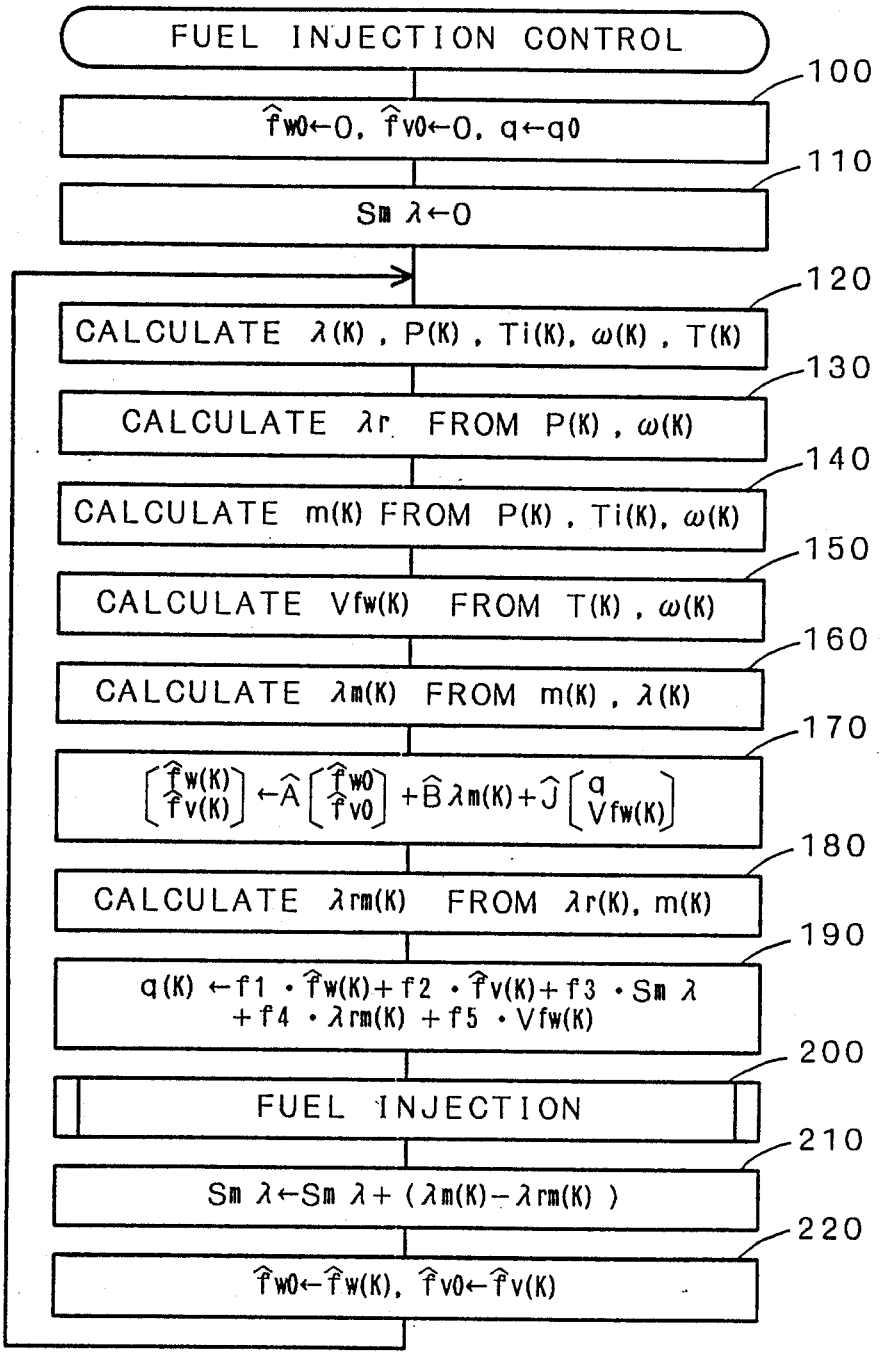
FIG. 4 is a flowchart describing a series of operations for the control of the present invention.

The fuel injection control executed by the electronic control circuit 30 will be described referring to a flowchart of FIG. 4. The variables used in the current processing will be hereinafter represented by subscript (k).

The process for fuel injection control begins with the start of the engine 2, and is repeatedly carried out during the operation of the engine 2.

When the process is initiated, step 100 is executed where the variables of both the adhering fuel amount estimation $\hat{f}wo$ and the vapor fuel amount estimation $\hat{f}vo$, and the fuel injecting amount q are initialized. At step 110, the integral value Sm$\lambda$ of the difference between the actual fuel amount $\lambda m$ and the target fuel amount $\lambda rm$ is set at 0. At step 120, the fuel/air ratio $\lambda(k)$, the pressure P(k), the intake air temperature Ti(k), the engine speed $\omega(k)$, and the fuel temperature T(k) are calculated based on the output signals from the respective sensors.

At step 130, the target fuel/air ratio $\lambda r$ responding to the load imposed on the engine 2 is calculated based on the pressure P(k) and the engine speed $\omega(k)$ obtained at step 120. At this step 130, the target fuel/air ratio $\lambda r$ is so set that an air excess rate of the air fuel mixture becomes 1, i.e., $\lambda r$ is set at the stoichiometric air/fuel ratio. In case of engine operation with heavy load, the target fuel/air ratio $\lambda r$ is set to the richer side so as to increase the output of the engine by increasing the fuel amount more than usual. In case of engine operation with light load, it is set to the leaner side so as to reduce the fuel consumption by decreasing the fuel amount less than usual.

After the target fuel/air ratio $\lambda r(k)$ is set at step 130, the control proceeds to step 140. The process at this step 140 is executed as the second calculator P4 in which the air amount m(k) coming into the cylinder 2a is calculated based on the pressure P(k), the intake air temperature Ti(k), and the engine speed $\omega(k)$ which are obtained at step 120, utilizing either the equation (2) or a predetermined data map representing such relation of equation (2).

The control further proceeds to step 150 where the process is executed as the first calculator P1 and the divider P2. At this step 150, the fuel evaporating amount Vf obtained based on the fuel temperature T(k) is divided by the engine speed $\omega(k)$ to calculate the evaporating amount Vfw(k), i.e., $Vf(k)/\omega(k)$, between cycle to cycle of the intake stroke. In this embodiment, the saturated vapor pressure Ps(k) is obtained from the equation (1) or a predetermined data map, and the pressure Ps(k) is used for calculating the evaporating fuel amount Vf based on the equation (1)'. Since the evaporating fuel amount Vf also changes dependent on the pressure P, it may be calculated based on the saturated vapor pressure Ps(k) obtained from the equation (1) and the pressure P(k) obtained at step 120.

The process at following step 160 is executed as the first multiplier P5 where the fuel/air ratio $\lambda(k)$ obtained at step 120 is multiplied by the air amount m(k) obtained at step 150 to calculate the actual fuel amount $\lambda m(k)$ that has come into the cylinder 2a at the previous intake stroke. Then the control proceeds to step 170 where the process is executed as the observer P11. At step 170, the estimations of the adhering fuel amount $\hat{f}w(k)$ and the vapor fuel amount $\hat{f}v(k)$ are provided based on the actual fuel amount $\lambda m(k)$ at step 160, the fuel injecting amount q obtained in the previous execution of the same routine, the evaporating amount Vfw(k) at step 150, and estimations of the adhering fuel amount $\hat{f}wo$ and the vapor fuel amount $\hat{f}vo$ obtained in the previous execution of the same routine, utilizing the equation (40).

The process at step 180 is executed as the second multiplier P6. At this step 180, the target fuel amount λrm(k) coming into the cylinder 2a is calculated by multiplying the target fuel/air ratio λr(k) set at step 130 by the air amount m(k) obtained at step 140. The control further proceeds to step 190 where the fuel injecting amount q is calculated based on the integral value Smλ of the difference between the actual fuel amount λm and the target fuel amount λrm, estimations $\hat{f}w(k)$ and $\hat{f}v(k)$ obtained at step 170, the target fuel amount λrm(k) at step 180, and the evaporating amount Vfw(k) at step 150, utilizing equation (36).

At step 200, the fuel injection control is executed by opening the fuel injection valve 32 during the period corresponding to the fuel injecting amount q(k) obtained at step 190 at the fuel injection timing determined based on the detection signal from the crank angle sensor 24.

When the fuel supply to the engine 2 is terminated after the execution of the fuel injection control at step 200, the control proceeds to step 210 where the process is executed as the summing portion P10. At step 210, the difference between the actual fuel injection amount λm(k) obtained at step 160 and the target fuel injection amount λrm(k) at step 180 are added to the integral value Smλ(k) obtained in the previous execution of the same routine to obtain an integral value Smλ(k). The control proceeds to step 220 where the estimations $\hat{f}w(k)$ and $\hat{f}v(k)$ obtained at step 170 are set as the values $\hat{f}wo$ and $\hat{f}vo$ used for providing estimations of the adhering fuel amount $\hat{f}w$ and the vapor fuel amount $\hat{f}v$ at next processing. The program then returns to step 120 again.

In the fuel injection system of this embodiment, the control law is set based on the physical model describing the behavior of fuel in the engine 2. Accordingly the behavior which varies responsive to the temperature of the intake pipe of the engine 2, i.e., warming-up state of the engine 2, can be compensated for its non-linearity by Vfw (Vf/ω), resulting in the fuel injection control covered by a single control law. This will eliminate cumbersome processing such as switching from one control law to another in accordance with the operating state of the engine, thereby simplifying the control system.

Since the system utilizes the physical model enabled to describe the behavior of fuel with high accuracy, it can perform the control without being influenced by disturbances in spite of the control law with lower order, thus improving the control accuracy.

The state variables estimated at the observer are the adhering fuel amount and the vapor fuel amount. Therefore, an abnormality of the system can be detected by determining whether they are estimated accurately by the observer.

In the above embodiment, the control system is designed based on the physical model represented by equations (7) and (8) on the assumption that all the fuel evaporating from the inner wall of the intake pipe is to be the vapor fuel. However, some part of the fuel evaporating at the intake stroke of the engine ($\frac{1}{4}$ of the total evaporating amount α5·Vf/w between an intake cycle to the next intake cycle in a 4-cycle engine) may not remain inside the intake pipe as the vapor fuel. Instead, it may directly flow into the cylinder of the engine. For the case, the equations (5) and (6) are rewritten to the following equations (50) and (51).

$$fv(k+1)=(1-\alpha 3)\cdot fv(k)+\alpha 6\cdot q(k)+3\cdot\alpha 5\cdot Vf(k)/4\cdot\omega(k) \quad (50)$$

$$fc(k)=\lambda(k)\cdot m(k)+\alpha 5\cdot Vf(k)/4\cdot\omega(k) \quad (51)$$

The physical model is modified as the following equations (52) and (53):

$$\begin{matrix} fw(k+1) \\ fv(k+1) \end{matrix} = \begin{bmatrix} 1-\alpha 2 & 0 \\ 0 & 1-\alpha 3 \end{bmatrix} \cdot \begin{bmatrix} fw(k) \\ fv(k) \end{bmatrix} + \begin{bmatrix} \alpha 4 \\ \alpha 6 \end{bmatrix} \cdot q(k) + \begin{bmatrix} -\alpha 5 \\ +\alpha 7 \end{bmatrix} \cdot Vf(k)/\omega(k) \quad (52)$$

$$\lambda(k)\cdot m(k) = [\alpha 2\ \alpha 3]\cdot\begin{bmatrix} fw(k) \\ fv(k) \end{bmatrix} + (1-\alpha 4-\alpha 6)\cdot q(k) + \alpha 8\cdot Vf(k)\cdot\omega(k) \quad (53)$$

where $\alpha 7=\alpha 5\cdot\frac{3}{4}$ and $\alpha 8=\alpha 5/4$. The control system can also be designed by this physical model.

In this case, the control system can be designed in the same manner as the above embodiment by the following equations.

$$y(k) = \lambda(k)\cdot m(k) - (1-\alpha 4-\alpha 6)\cdot q(k) - \alpha 8\cdot Vf(k)\cdot\omega(k) \quad (54)$$

$$x(k) = [fw(k)\ fv(k)]^T \quad (55)$$

$$\Phi = \begin{bmatrix} 1-\alpha 2 & 0 \\ 0 & 1-\alpha 3 \end{bmatrix} \quad (56)$$

$$\Gamma = \begin{bmatrix} \alpha 4 \\ \alpha 6 \end{bmatrix} \quad (57)$$

$$\pi = \begin{bmatrix} -\alpha 5 \\ +\alpha 7 \end{bmatrix} \quad (58)$$

$$\theta = [\alpha 2\ \alpha 3] \quad (59)$$

Since the equations (52), (53) can be represented as the aforementioned equations (15), (16), the state equation which is linearly approximated and extended to the servo system shown by the equation (19) is obtained in the same manner as the above embodiment. Then the equation (34) is derived from solving the Ricacci equation. Substituting the equations (54) and (55) into the equation (34) provides the following equation (60).

$$\begin{aligned} q(k) &= \Big\{ Fa\cdot fw(k) + Fb\cdot fv(k) + \sum_{j=0}^{k-1} Fc\cdot m(j)\cdot(\lambda(j)-\lambda r) + Fd\cdot m(k)\cdot\lambda r + (Fe - Fd\cdot\alpha 8)\cdot Vf(k)/\omega(k) \Big\} / \{1 + Fd\cdot(1-\alpha 4-\alpha 6)\} \\ &= f1\cdot fw(k) + f2\cdot fv(k) + \sum_{j=0}^{k-1} f3\cdot m(j)\cdot(\lambda(j)-\lambda r) + f4\cdot m(k)\cdot\lambda r + f5\cdot Vf(k)/\omega(k) \end{aligned} \quad (60)$$

Then the control system can be designed, which is the same as the above embodiment shown in FIG. 3.

The observer P11 shown in FIG. 3 is also designed based on the equation (40) in the same manner as the above embodiment.

In the above embodiment, estimations $\hat{f}w$ and $\hat{f}v$ of the adhering fuel amount fw and the vapor fuel amount fv obtained by the observer P11 are used as it is for the control. However in case of the engine operation with light load, at low engine speed, and at a high cooling water temperature of 80° C. or more, the adhering fuel amount fw might be estimated as negative due to an increase in the evaporating amount $Vf/\omega$ calculated at every intake stroke. In practice, since the adhering fuel amount fw can not become negative, such estimation would disturb the stable control.

Figure 5:
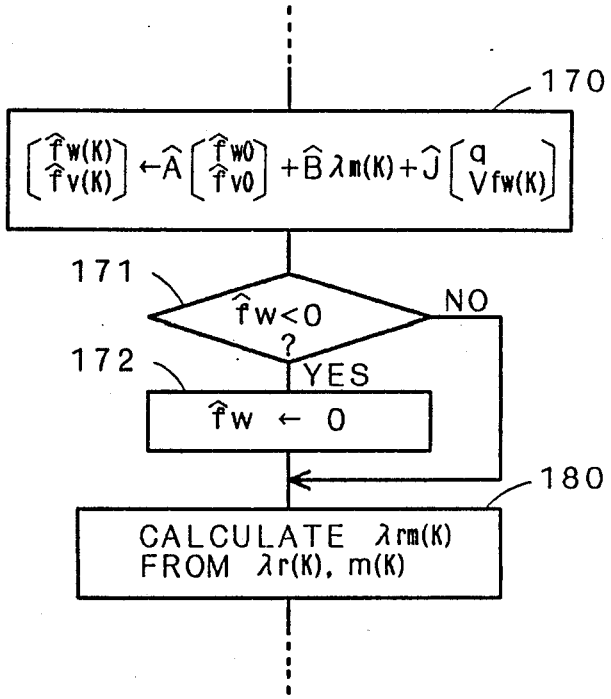
FIG. 5 is a flowchart describing a modification of the fuel injection control according to the first embodiment of the present invention.

The processes executed by steps 171 and 172 shown in FIG. 5 are required for solving the aforementioned problem. At those steps, after the amount fw is estimated at step 170 shown in FIG. 4, it is determined whether the estimated value $\hat{f}w$ is negative. If the value is determined to be negative, it is set at 0.

Figure 1A:
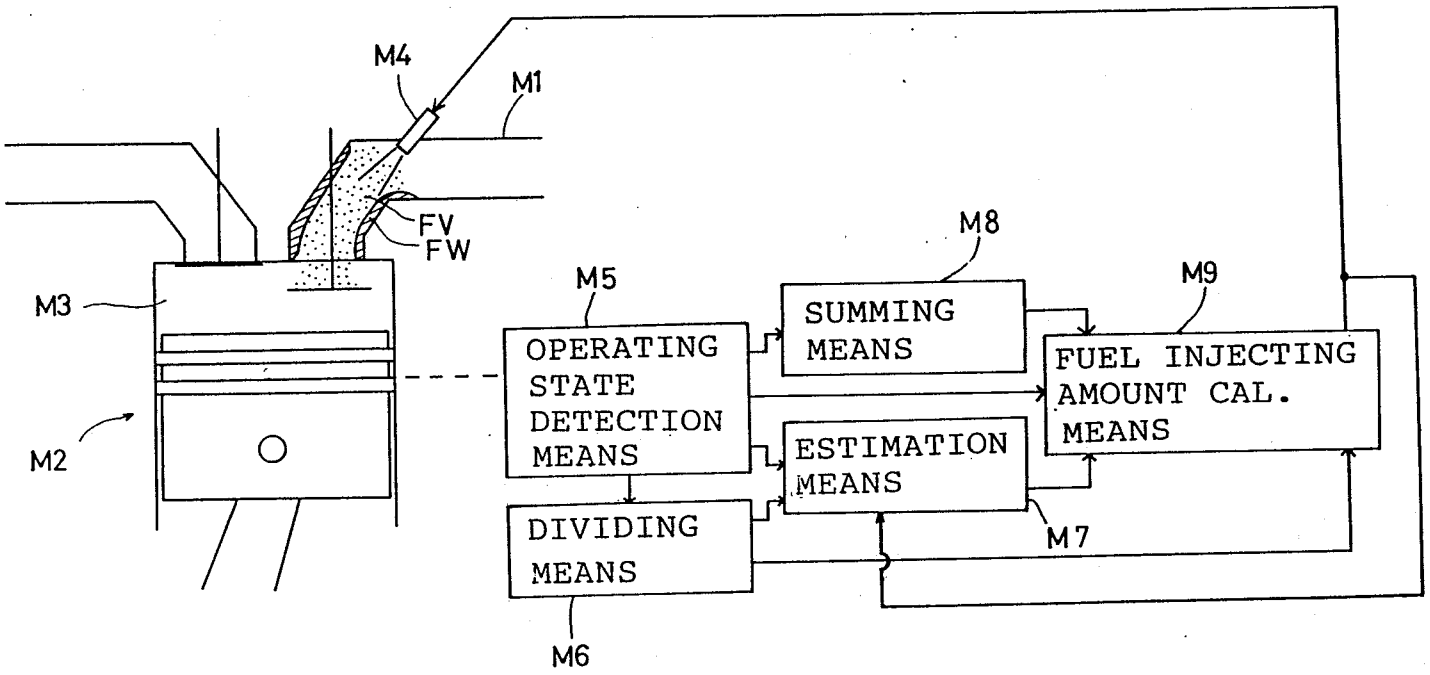
FIG. 1A is a block diagram representing a construction of the present invention.
Figure 1B:
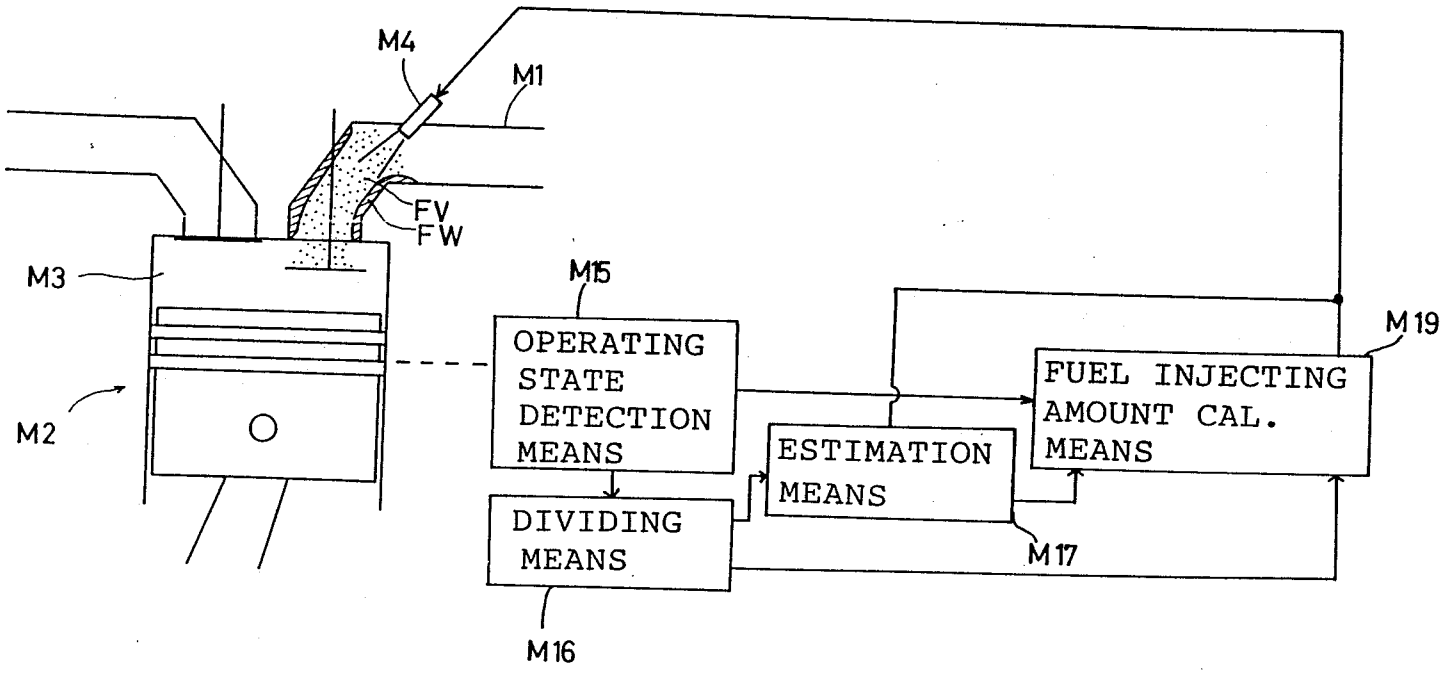
FIG. 1B is a block diagram representing a construction of another feature of the present invention.

A second embodiment will be described, which corresponds to the second feature of the present invention shown in FIG. 1B.

Figure 6:
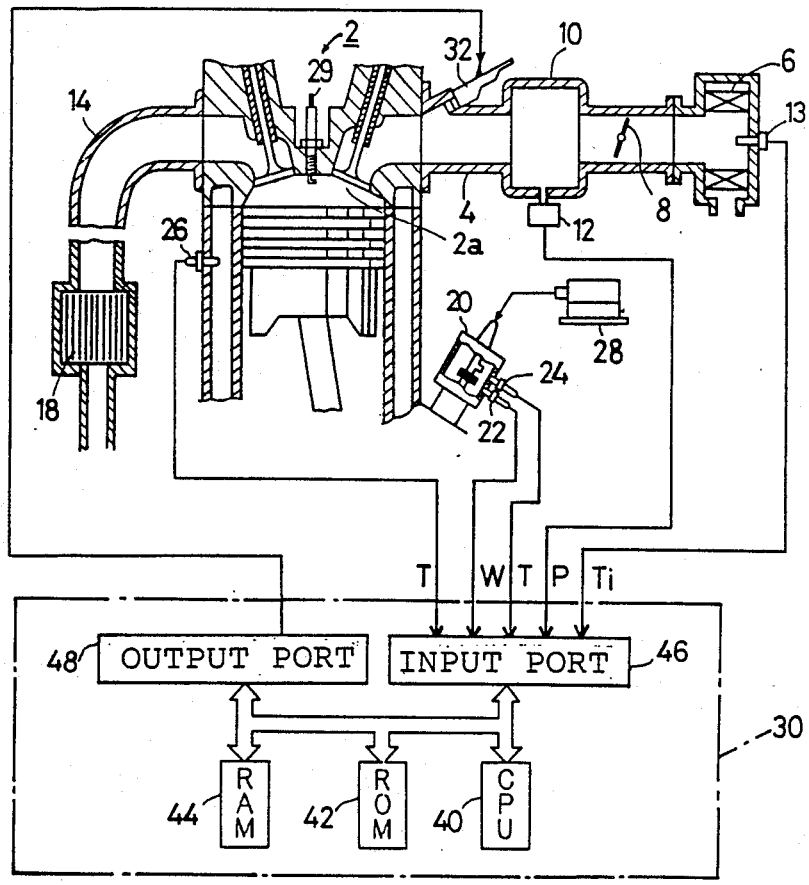
FIG. 6 is a schematic diagram illustrating an internal combustion engine and its peripheral equipment according to a second embodiment of the present invention.

The schematic diagram illustrating the internal combustion engine 2 and its peripheral equipments applied to this embodiment are shown in FIG. 6. The construction of them, however, is different from that of the first embodiment shown in FIG. 2 only in that the oxygen sensor (air/fuel ratio sensor) of the exhaust pipe 14 is excluded. Accordingly this embodiment is different from the first one in that the fuel/air ratio λ is not used in the control to be described hereinafter.

Figure 7:
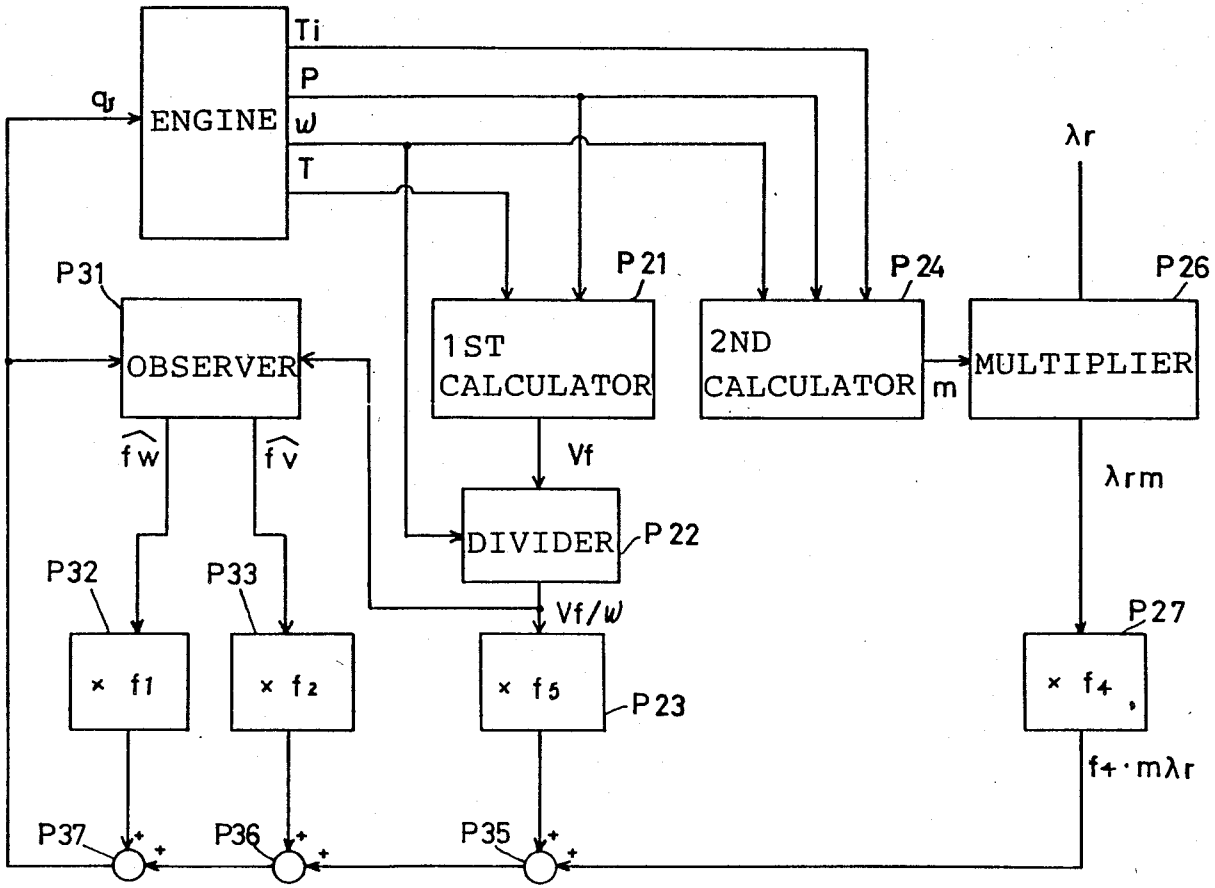
FIG. 7 is a block diagram representing another control system of the present invention.

The control system of the second embodiment is represented by the block diagram of FIG. 7. As shown in FIG. 7, the control system is not provided with the first multiplier P5, adder P8, summing portion P10, multiplier P9, and adder P14 shown in FIG. 3. The observer P31 is constructed to calculate estimations $\hat{f}w$ and $\hat{f}v$ without using the fuel/air ratio λ. Since the other parts of the construction are the same as those of the first embodiment, the numerals designating the identical parts will be added by 20.

The design method of the control system of FIG. 7 will be described.

If the following equations are provided:

$$x(k) = [fw(k)\, fv(k)]^T \tag{70}$$

$$\Phi = \begin{bmatrix} 1-\alpha 2 & 0 \\ 0 & 1-\alpha 3 \end{bmatrix} \tag{71}$$

$$\Gamma = \begin{bmatrix} \alpha 4 \\ \alpha 6 \end{bmatrix} \tag{72}$$

$$E = \begin{bmatrix} -\alpha 5 \\ +\alpha 5 \end{bmatrix} \tag{73}$$

$$w(k) = [Vf(k)/\omega(k)] \tag{74}$$

$$y(k) = [\lambda(k) \cdot m(k)] \tag{75}$$

$$u(k) = [q(k)] \tag{76}$$

$$A = [1-\alpha 4-\alpha 6] \tag{77}$$

$$\theta = [\alpha 2\ \alpha 3] \tag{78}$$

the equations (7) and (8) are represented by the following equations, respectively.

$$x(k+1)=\Phi\cdot x(k)+\Gamma\cdot u(k)+E\cdot w(k) \tag{79}$$

$$y(k)=\theta\cdot x(k)+\Lambda\cdot u(k) \tag{80}$$

In case of steady state with y(k)=yr (target value), supposing u(k)=ur and x(k)=xr entails that the equations (79) and (80) are represented by the following equations (79)′ and (80)′.

$$xr=\Phi\cdot xr+\Gamma\cdot ur+E\cdot w(k) \tag{79'}$$

$$yr=\theta\cdot xr+\Lambda\cdot ur \tag{80'}$$

From the above equations (79), (79)′, and (80), (80)′, the following equations are derived.

$$x(k+1)-xr=\Phi\cdot(x(k)-xr)+\Gamma\cdot(u(k)-ur) \tag{81}$$

$$y(k)-yr=\theta(x(k)-xr)+\Lambda\cdot(u(k)-ur) \tag{82}$$

If the following equations are provided:

$$X(k)=x(k)-xr \tag{83}$$

$$U(k)=u(k)-ur \tag{84}$$

$$Y(k)=y(k)-yr-\Lambda\cdot(u(k)-ur) \tag{85}$$

the equations (81) and (82) become as follows.

$$X(k+1)=\Phi\cdot X(k)+\Gamma\cdot U(k) \tag{86}$$

$$Y(k)=\theta\cdot X(k) \tag{87}$$

In the above equations (86) and (87), supposing X(k)→0 entails Y(k)=0. Also supposing u(k)→ur entails y(k)→yr. The next step is to design the optimal regulator of the above equation (86) can be designed. That is, the optimal regulation is obtained as shown in the following equation (88), by solving discrete Ricacci equation.

$$U(k)=F\cdot X(k) \tag{88}$$

The equation (88) is transformed into the following equation (89) utilizing the equations (83) and (84).

$$u(k)=F\cdot x(k)-F\cdot xr+ur \tag{89}$$

If xr and ur in equations (79)′ and (80)′ are given by the following equation (90), the above equation (79) is determined to provide u(k).

$$\begin{bmatrix} I-\Phi & -\Gamma \\ \theta & \Delta \end{bmatrix}\cdot\begin{bmatrix} xr \\ ur \end{bmatrix}=\begin{bmatrix} E\cdot w(k) \\ yr \end{bmatrix} \tag{90}$$

In this embodiment, the above equation (90) is rewritten as the following equation (91) from the equations (70) through (78).

$$\begin{bmatrix} \alpha 2 & 0 & -\alpha 4 \\ 0 & \alpha 3 & -\alpha 6 \\ \alpha 2 & \alpha 3 & 1-\alpha 4-\alpha 6 \end{bmatrix}\cdot\begin{bmatrix} fwr \\ fvr \\ qr \end{bmatrix}=\begin{bmatrix} -\alpha 5\cdot Vf(k)/\omega(k) \\ +\alpha 5\cdot Vf(k)/\omega(k) \\ \lambda r\cdot m(k)-(1-\alpha 4-\alpha 6)\cdot u(k) \end{bmatrix} \tag{91}$$

Thus, the values xr and ur (i.e., fwr, fvr and qr) are obtained as follows.

$$fwr=\beta 11\cdot Vf(k)/\omega(k)+\beta 12\cdot\{\lambda r\cdot m(k)-(1-\alpha 4-\alpha 6)\cdot u(k)\} \quad (92)$$

$$fvr=\beta 21\cdot Vf(k)/\omega(k)+\beta 22\cdot\{\lambda r\cdot m(k)-(1-\alpha 4-\alpha 6)\cdot u(k)\} \quad (93)$$

$$qr=\beta 21\cdot Vf(k)/\omega(k)+\beta 23\cdot\{\lambda r\cdot m(k)-(1-\alpha 4-\alpha 6)\cdot u(k)\} \quad (94)$$

where $\alpha 11$ through $\alpha 23$ are constants.

The following equation (95) is obtained from the equation (89) using coefficients f1, f2, f4, and f5.

$$u(k)=f1\cdot fw(k)+f2\cdot fv(k)+f4\cdot m(k)\lambda r+f5\cdot Vf(k)/\omega(k) \quad (95)$$

In this way, the control system shown in FIG. 7 can be designed.

The equation (95) corresponds to the second equation in the fuel injecting amount calculation means M19 for obtaining the fuel injecting amount.

The observer P31 is so constructed to estimate the adhering fuel amount fw and the vapor fuel amount fv utilized in the equation (95) since they cannot be directly measured. Gopinath design method or the like is known for the design method of the observer of this type. This embodiment cannot use the conventional observer because the air/fuel ratio $\lambda$ of the mixture which is actually supplied to the engine 2 cannot be measured. However, the equation (7) which describes the behavior of fuel in the engine 2 provides the amounts fw and fv without the actual value of $\lambda$. The reason is as follows.

The second and third terms of the right side of the equation (7) be calculated because q(k) is derived from the electronic control circuit 30 as the control parameter, Vf(k) is detected by the saturated vapor pressure Ps from the cooling water temperature T from the sensor 26, and the intake pipe pressure P from the sensor 12, and further the engine speed $\omega(k)$ is detected by the engine speed sensor 22. If the following equations (96) and (97) are provided, the equation (98) is obtained as below.

$$\delta w(k) = fw(k) - \hat{f}w(k) \quad (96)$$

$$\delta v(k) = fv(k) - \hat{f}v(k) \quad (97)$$

$$\begin{bmatrix} \delta w(k+1) \\ \delta v(k+1) \end{bmatrix} = \begin{bmatrix} 1-\alpha 2 & 0 \\ 0 & 1-\alpha 3 \end{bmatrix} \cdot \begin{bmatrix} \delta w(k) \\ \delta v(k) \end{bmatrix} + \begin{bmatrix} \alpha 4 \\ \alpha 6 \end{bmatrix} \cdot q(k) \quad (98)$$

The equation (98) is stable because $1-\alpha 2<1$ and $1-\alpha 3<3$ 1. Therefore, $\delta w(k)$ and $\delta v(k)\rightarrow 0$, i.e., $\hat{f}w(k)\rightarrow fw(k)$, and $\hat{f}v(k)\rightarrow fv(k)$. If appropriate initial values are provided for fw(k) and fv(k), they can be estimated by utilizing the equation (7).

Figure 8:
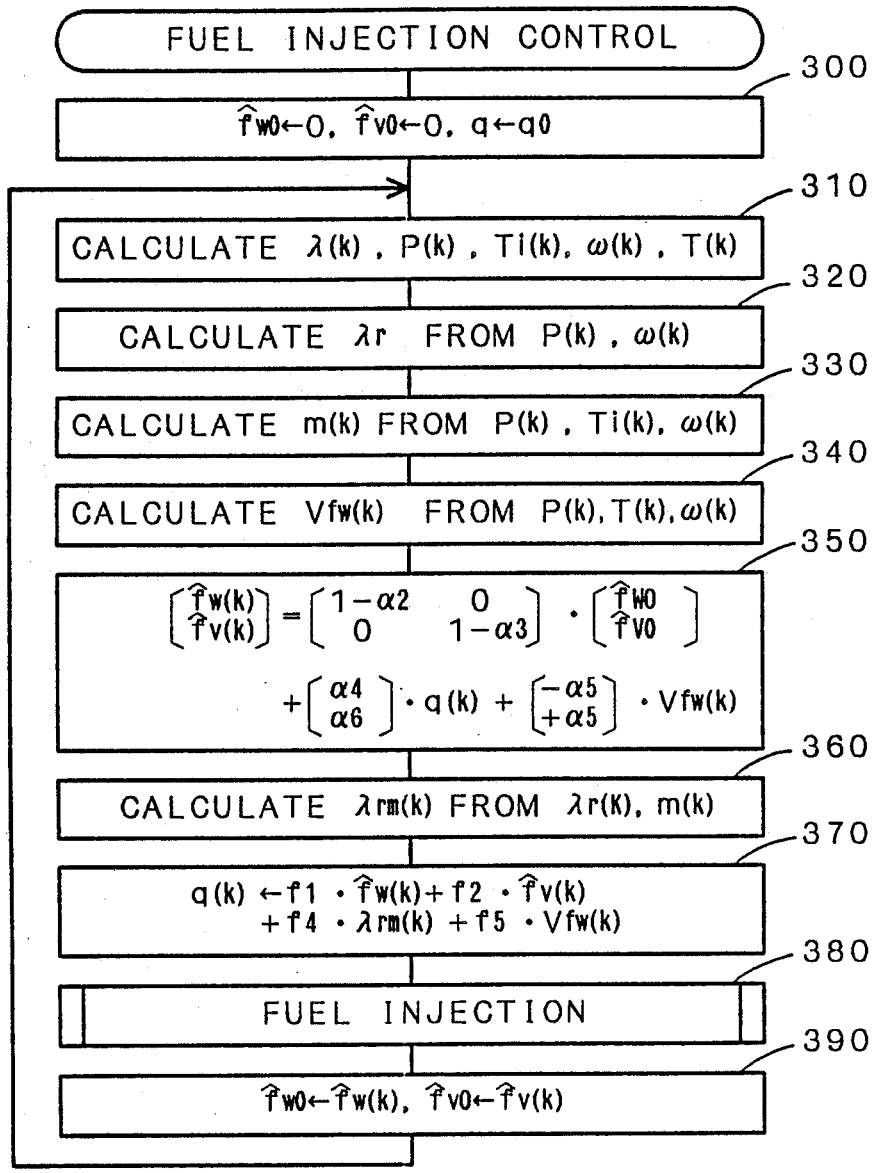
FIG. 8 is a flowchart describing another series of operations for the control of the present invention.

In this embodiment, the observer P31 is so constructed to estimate the adhering fuel amount fw and the vapor fuel amount fv by utilizing the equation (7). Even if the disturbance brings such conditions as $fw(k)\neq\hat{f}w$, and $fv(k)\neq\hat{f}v$, the equation (95) will provide u(k) (i.e., fuel injecting amount q(k)) with no problem, since the $\hat{f}w(k)$ and $\hat{f}v(k)$ follow fw(k) and fv(k), The fuel injection control executed by the electronic control circuit 30 in this second embodiment will be described referring to a flowchart of FIG. 8. Hereinafter, the variables used for the current processing will be represented by subscript (k).

The process for fuel injection control begins with the start of the engine 2, and is repeatedly carried out during the operation of the engine 2.

When the process is initiated, step 300 is executed where the variables of the adhering fuel amount estimation $\hat{f}wo$ and the vapor fuel amount estimation $\hat{f}vo$, and the fuel injecting amount q are initialized. At step 310, intake pipe pressure P(k), intake air temperature Ti(k), engine speed $\omega(k)$, and cooling water temperature T(k) are obtained based on the output signals from the respective sensors. Then the control proceeds to step 320 where a target fuel/air ratio $\lambda r$ responding to the load imposed on the engine 2 is calculated based on the P(k) and $\omega(k)$ obtained at step 310. At this step 320, the target fuel/air ratio $\lambda r$ is so set that an air excess rate of the air fuel mixture becomes 1, i.e., at the stoichiometric air/fuel ratio. In case of the engine operation with heavy load, the target fuel/air ratio $\lambda r$ is set to the richer side to increase the output of the engine by increasing the fuel amount more than usual. Conversely in case of the engine operation with light load, it is set to the leaner side to reduce the fuel consumption by decreasing the fuel amount less than usual.

After the target fuel/air ratio $\lambda r(k)$ is set at step 320, the control proceeds to step 330. The process at step 330 is executed as the second calculator P24 in which an air amount m(k) coming into the cylinder 2a is calculated based on P(k), Ti(k), and $\omega(k)$ obtained at step 320, utilizing either the equation (2) or a predetermined data map.

The process at the following step 340 is executed as the first calculator P21 and the divider P22. At this step 340, the fuel evaporating amount Vf obtained based on T(k) and P(k) at step 310 is divided by the engine speed $\omega(k)$ to calculate the evaporating amount Vfw(k), i.e., $Vf(k)/\omega(k)$ between an intake cycle to the next intake cycle.

The process at step 350 is executed as the observer P31 in which estimations of the adhering fuel amount $\hat{f}w(k)$ and the vapor fuel amount $\hat{f}v(k)$ are provided based on the evaporating amount Vfw(k) at step 340, the fuel injecting amount q obtained in the previous execution of the same routine, and estimations $\hat{f}wo$, $\hat{f}vo$ obtained in the previous execution of the same routine, utilizing the following equation (99) which is derived from the equation (7).

$$\begin{bmatrix} fw(k) \\ fv(k) \end{bmatrix} = \begin{bmatrix} 1-\alpha 2 & 0 \\ 0 & 1-\alpha 3 \end{bmatrix} \cdot \begin{bmatrix} fwo \\ fvo \end{bmatrix} + \begin{bmatrix} \alpha 4 \\ \alpha 6 \end{bmatrix} \cdot q(k) + \begin{bmatrix} -\alpha 5 \\ +\alpha 5 \end{bmatrix} \cdot Vfw(k) \quad (99)$$

The process at step 360 is executed as the multiplier P26. There, the target fuel amount $\lambda rm(k)$ coming into the cylinder 2a is calculated by multiplying the target fuel/air ratio $\lambda r/(k)$ set at step 320 by the air amount m(k) at step 330. The control proceeds to step 370 where the fuel injecting amount q(k) is calculated based on the estimations $\hat{f}w(k)$, $\hat{f}v(k)$ obtained at step 350, the target fuel amount $\lambda rm(k)$ at step 360, and the evaporating amount Vfw(k) at step 340, utilizing the equation (95).

At step 380, the fuel injection is executed by opening the fuel injection valve 32 during the period corresponding to the fuel injecting amount q(k) determined at step 370 at the fuel injection timing determined based on the detection signal from the crank angle sensor 24.

When the fuel supply to the engine 2 is terminated after the execution of the fuel injection at step 380, the control proceeds to step 390. At step 390, the estimation $\hat{f}w(k)$ and $\hat{f}v(k)$ obtained at step 350 are set as the values of the adhering fuel amount $\hat{f}wo$ and the vapor fuel amount $\hat{f}vo$ used for providing estimations $\hat{f}w$ and $\hat{f}v$ at next processing. Then the program returns to step 310 again.

In the fuel injection system of this embodiment, the control law is set based on the physical model describing the behavior of fuel in the engine 2. The behavior which varies responsive to the temperature of the intake pipe in the engine 2, i.e., warming-up state of the engine, can be compensated for its non-linearity by Vfw, i.e., $Vf/\omega$. Accordingly the fuel injection control is covered by a single control law. This will eliminate the cumbersome processing such as switching from one control law to another in accordance with the operating state of the engine, thereby simplifying the control system.

The fuel/air ratio can be adjusted to the target ratio without using a sensor for detecting the fuel/air ratio λ of the mixture actually supplied to the engine 2, thereby simplifying the construction of the device.

The state variables estimated at the observer are the adhering fuel amount and the vapor fuel amount. Therefore, an abnormality of the system can be detected by determining whether they are estimated accurately by the observer.

The control system of this embodiment is designed based on the physical model represented by the equations (7) and (8) on the assumption that all the fuel evaporating from the inner wall of the intake pipe would be the vapor fuel. However, some part of the evaporating fuel at the intake stroke of the engine ($\frac{1}{4}$ of the total evaporating amount $\alpha 5 \cdot Vf/\omega$ between an intake cycle to the next intake cycle in a 4-cycle engine) may not remain inside the intake pipe as the vapor fuel. Instead it may directly flow into the cylinder of the engine. Thus the equations (5) and (6) are rewritten to the equations (100) and (101) as follows.

$$fv(k+1)=(1-\alpha 3)\cdot fv(k)+\alpha 6\cdot q(k)+3\cdot\alpha 5\cdot Vf(k)/4\cdot\omega(k) \quad (100)$$

$$fc(k)=\lambda(k)\cdot m(k)+\alpha 5\cdot Vf(k)/4\cdot\omega(k) \quad (101)$$

The physical model is modified as the following equations (102) and (103):

$$\begin{matrix} fw(k+1) \\ fv(k+1) \end{matrix} = \begin{bmatrix} 1-\alpha 2 & 0 \\ 0 & 1-\alpha 3 \end{bmatrix} \cdot \begin{bmatrix} fw(k) \\ fv(k) \end{bmatrix} + \begin{bmatrix} \alpha 4 \\ \alpha 6 \end{bmatrix} \cdot q(k) + \begin{bmatrix} -\alpha 5 \\ +\alpha 7 \end{bmatrix} \cdot Vf(k)/\omega(k) \quad (102)$$

$$\lambda(k)\cdot m(k) = [\alpha 2\ \alpha 3] \cdot \begin{bmatrix} fw(k) \\ fv(k) \end{bmatrix} + (1-\alpha 4-\alpha 6)\cdot q(k) + \alpha 8\cdot Vf(k)\cdot\omega(k) \quad (103)$$

where $\alpha 7=\alpha 5\cdot\frac{3}{4}$ and $\alpha 8=\alpha 5/4$. The control system can be designed from this physical model.

In this embodiment, the observer P31 is designed by using the equation (7). A known observer may be available in which the state variables are estimated on the assumption that the fuel/air ratio λ is controlled to coincide with the target fuel/air ratio λr.

In case a minimal order observer is designed from the equation (7), the following equation is given.

$$\begin{bmatrix} \hat{f}w(k+1) \\ \hat{f}v(k+1) \end{bmatrix} = \hat{A} \cdot \begin{bmatrix} \hat{f}w(k) \\ \hat{f}v(k) \end{bmatrix} + \hat{B}\cdot\lambda m(k) + \hat{J} \cdot \begin{bmatrix} q(k) \\ Vf(k)/\omega(k) \end{bmatrix} \quad (104)$$

This observer cannot be directly applied to the device which does not detect the fuel/air ratio λ. However, the adhering fuel amount fw and the vapor fuel amount fv can be estimated by making the second term of the equation (104) as $\hat{B}\lambda rm(k)$ on the assumption that the fuel/air ratio λ is adjusted to the target ratio λr by the fuel injection control.

What is claimed is:

1. A fuel injection system of an internal combustion engine (M2) for determining a fuel injecting amount q of a fuel injection valve (M4) based on a physical model describing a behavior of fuel coming into a cylinder (M3) of the engine (M2) utilizing an amount fw of fuel adhering to an inner wall of an intake pipe (M1) and an amount fv of vapor fuel in the intake pipe (M1) as state variables, the system comprising:

an operating state detection means (M5) for detecting a rotating speed ω of the engine (M2), an evaporating amount Vf of the fuel adhering to the inner wall of the intake pipe (M1), a fuel/air ratio λ of a mixture coming into the cylinder (M3), and an amount m of air coming into the cylinder (M3);

a dividing means (M6) for dividing the evaporating amount Vf by the engine speed ω;

an estimation means (M7) for calculating estimation values $\hat{f}w$ and $\hat{f}v$ of the adhering fuel amount fw and the vapor fuel amount fv, based on a product λ·m of the detected fuel/air ratio λ and the detected air amount m, said division $Vf/\omega$ at the dividing means (M6) and the injecting amount q, utilizing a first equation determined from the physical model;

a summing means (M8) for summing up a difference m·(λ−λr) between the product λ·m and a product λr·m of a preset target fuel/air ratio λr and the air amount m; and a fuel injecting amount calculation means (M9) for calculating the fuel injecting amount q, based on the division $Vf/\omega$, the estimated values fw and fv, the product λr·m, and the difference summed up at the summing means (M8), utilizing a second equation determined from the physical model.

2. The fuel injection system according to claim 1, wherein the first equation utilized in the estimation means (M7) is as follows:

$$\begin{bmatrix} \hat{f}w(k+1) \\ \hat{f}v(k+1) \end{bmatrix} = \hat{A} \cdot \begin{bmatrix} \hat{f}w(k) \\ \hat{f}v(k) \end{bmatrix} +$$

-continued $$\hat{B} \cdot \lambda(k) \cdot m(k) + \hat{J} \cdot \begin{bmatrix} q(k) \\ Vf(k)/\omega(k) \end{bmatrix}$$

where subscript k denotes calculation at k-th time and k+1 denotes (k+1)-th time and matrices $\hat{A}$, $\hat{B}$ and $\hat{J}$ are determined from the physical model.

3. The fuel injection system according to claim 2, wherein the second equation utilized in the fuel injecting amount calculation means (M9) is as follows:

$$q(k) = f1 \cdot \hat{fw}(k) + f2 \cdot \hat{fv}(k) + \sum_{j=0}^{k-1} f3 \cdot m(j) \cdot (\lambda(j) - \lambda r) + f4 \cdot m(k) \cdot \lambda r + f5 \cdot Vf(k)/\omega(k)$$

where coefficients f1, f2, f3, f4 and f5 are determined from the physical model.

4. The fuel injection system according to claim 3, wherein the evaporating amount Vf is determined from a temperature T of the engine (M2) at the operating state detection means (M5), utilizing the following equations: $Vf = \beta 4 \cdot Ps$, and $$Ps = \beta 1 \cdot T^2 - \beta 2 \cdot T + \beta 3,$$

where Ps is a saturated vapor pressure of the fuel and $\beta 1$, $\beta 2$, $\beta 3$ and $\beta 4$ are constants.

5. The fuel injection system according to claim 4, wherein the estimation value of the adhering fuel amount $\hat{fw}$ is set at 0 at the estimation means (M7) when the calculated estimation value of the adhering fuel amount $\hat{fw}$ is negative.

6. A fuel injection system of an internal combustion engine (M2) for determining an injecting amount q of a fuel injection valve (M4) based on a physical model describing a behavior of fuel coming into a cylinder (M3) of the engine (M2) utilizing an amount fw o fuel adhering to an inner wall of an intake pipe (M1) and an amount fv of vapor fuel in the intake pipe (M1) as state variables, the system comprising:

an operating state detection means (M15) for detecting a rotating speed $\omega$ of the engine (M2), an evaporating amount Vf of the fuel adhering to the inner wall of the intake pipe (M1) and an amount m of air coming into the cylinder (M3);

a dividing means (M16) for dividing the evaporating amount Vf by the engine speed $\omega$;

an estimation means (M17) for calculating estimation values $\hat{fw}$ and $\hat{fv}$ of the adhering fuel amount fw and the vapor fuel amount fv, based on the division $Vf/\omega$ at the dividing means (M16) and the injecting amount q, utilizing a first equation determined from the physical model;

a fuel injecting amount calculation means (M19) for calculating the fuel injecting amount q, based on the division $Vf/\omega$, the estimation values $\hat{fw}$ and $\hat{fv}$, and a product $\lambda r \cdot m$ of the detected air amount m and a target fuel/air ratio $\lambda r$, utilizing a second equation determined from the physical model.

7. The fuel injection system according to claim 6, wherein the first equation utilized in the estimation means (M17) is as follows:

$$\begin{bmatrix} \hat{fw}(k+1) \\ \hat{fv}(k+1) \end{bmatrix} = \begin{bmatrix} 1-\alpha 2 & 0 \\ 0 & 1-\alpha 3 \end{bmatrix} \cdot \begin{bmatrix} \hat{fw}(k) \\ \hat{fv}(k) \end{bmatrix} + \begin{bmatrix} \alpha 4 \\ \alpha 6 \end{bmatrix} \cdot q(k+1) + \begin{bmatrix} -\alpha 5 \\ +\alpha 5 \end{bmatrix} \cdot Vf(k+1)/\omega(k+1)$$

where subscript k denotes calculation at k-th time and k+1 denotes (k+1)-th time and coefficients $\alpha 1$, $\alpha 2$, $\alpha 3$, $\alpha 4$, $\alpha 5$ and $\alpha 6$ are determined from the physical model.

8. The fuel injection system according to claim 7, wherein the second equation utilized in the fuel injecting amount calculation means (M19) is as follows:

$$q(k) = f1 \cdot \hat{fw}(k) + f2 \cdot \hat{fv}(k) + f4 \cdot m(k) \cdot \lambda r + f5 \cdot Vf(k)/\omega(k)$$

where coefficients f1, f2, f4 and f5 are determined from the physical model.

9. The fuel injection system according to claim 8, wherein the evaporating amount Vf is determined from a saturated vapor pressure Ps of the fuel and a pressure P of the intake air at the operating state detection means (M15), the saturated vapor pressure Ps being determined from a temperature T of the engine (M2) utilizing the following equation:

$$Ps = \beta 1 \cdot T^2 - \beta 2 \cdot T + \beta 3,$$

where $\beta 1$, $\beta 2$ and $\beta 3$ are constants.

* * * * *